United States Patent [19]

Dutu et al.

[11] Patent Number: 4,555,992

[45] Date of Patent: Dec. 3, 1985

[54] COAL GASIFICATION INSTALLATION

[75] Inventors: Jacques Dutu, Presles; Paul Cosar, Paris, both of France

[73] Assignee: Fives-Cail Babcock, Paris, France

[21] Appl. No.: 640,328

[22] Filed: Aug. 13, 1984

[30] Foreign Application Priority Data

Aug. 31, 1983 [FR] France ..... 83 13961

[51] Int. Cl.[4] ..... F23G 5/00

[52] U.S. Cl. ..... 110/229; 48/77; 110/234; 110/245; 122/4 D

[58] Field of Search ..... 110/229, 263, 245, 347, 110/234; 48/77, 111; 122/4 D

[56] References Cited

U.S. PATENT DOCUMENTS

| | | | |
|---|---|---|---|
| 3,982,884 | 9/1976 | Godel | 432/14 |
| 4,268,274 | 5/1981 | Caughey | 110/229 X |
| 4,308,034 | 12/1981 | Hoang | 110/229 X |
| 4,416,418 | 11/1983 | Goodstine et al. | 110/245 X |
| 4,417,528 | 11/1983 | Vining et al. | 110/229 |
| 4,419,940 | 12/1983 | Cosar et al. | 110/129 |
| 4,463,686 | 8/1984 | Premel | 110/171 X |

*Primary Examiner*—Edward G. Favors
*Attorney, Agent, or Firm*—Kurt Kelman

[57] ABSTRACT

An installation for gasifying coal in a fluidized bed under high pressure has a vessel resistant to the high pressure and a reactor disposed in the interior of the vessel and having a principal chamber constituting a gasification chamber which permits the establishment of a principal fluidized bed of substantial depth and an auxiliary fluidized bed of a smaller depth. An inclined traveling grate forms the bottom of the gasification chamber and has a lower grate portion supporting the principal fluidized bed and an upper grate portion supporting the auxiliary bed situated in a space between the vessel walls and the gasification chamber. The principal and auxiliary fluidized beds are maintained in hydrostatic equilibrium.

14 Claims, 3 Drawing Figures

COAL GASIFICATION INSTALLATION

The present invention relates to an installation for gasifying coal in a fluidized bed under high pressure.

U.S. Pat. No. 4,419,940, dated Dec. 13, 1983, discloses a boiler installation operating with a solid fuel in a two-stage process wherein the fuel is gasified in a first stage in a fluidized bed. The structure of this installation does not permit operations at elevated pressures, such as 30 bars, for example, since the walls of the gasification chamber are not resistant to high pressures.

It is the primary object of this invention to make an installation of the indicated type capable of operating at high pressures in a simple and dependable manner.

The above and other objects are accomplished according to the invention with an installation which has a vessel resistant to the high pressure and a reactor disposed in the interior of the vessel and having a principal chamber constituting a gasification chamber which permits the establishment of a principal fluidized bed of substantial depth and an auxiliary fluidized bed of a smaller depth. An inclined traveling grate forms the bottom of the gasification chamber and has a lower grate portion supporting the principal fluidized bed and an upper grate portion supporting the auxiliary bed situated in a space between the vessel walls and the gasification chamber. The principal and auxiliary fluidized beds are maintained in hydrostatic equilibrium.

Figure 1:
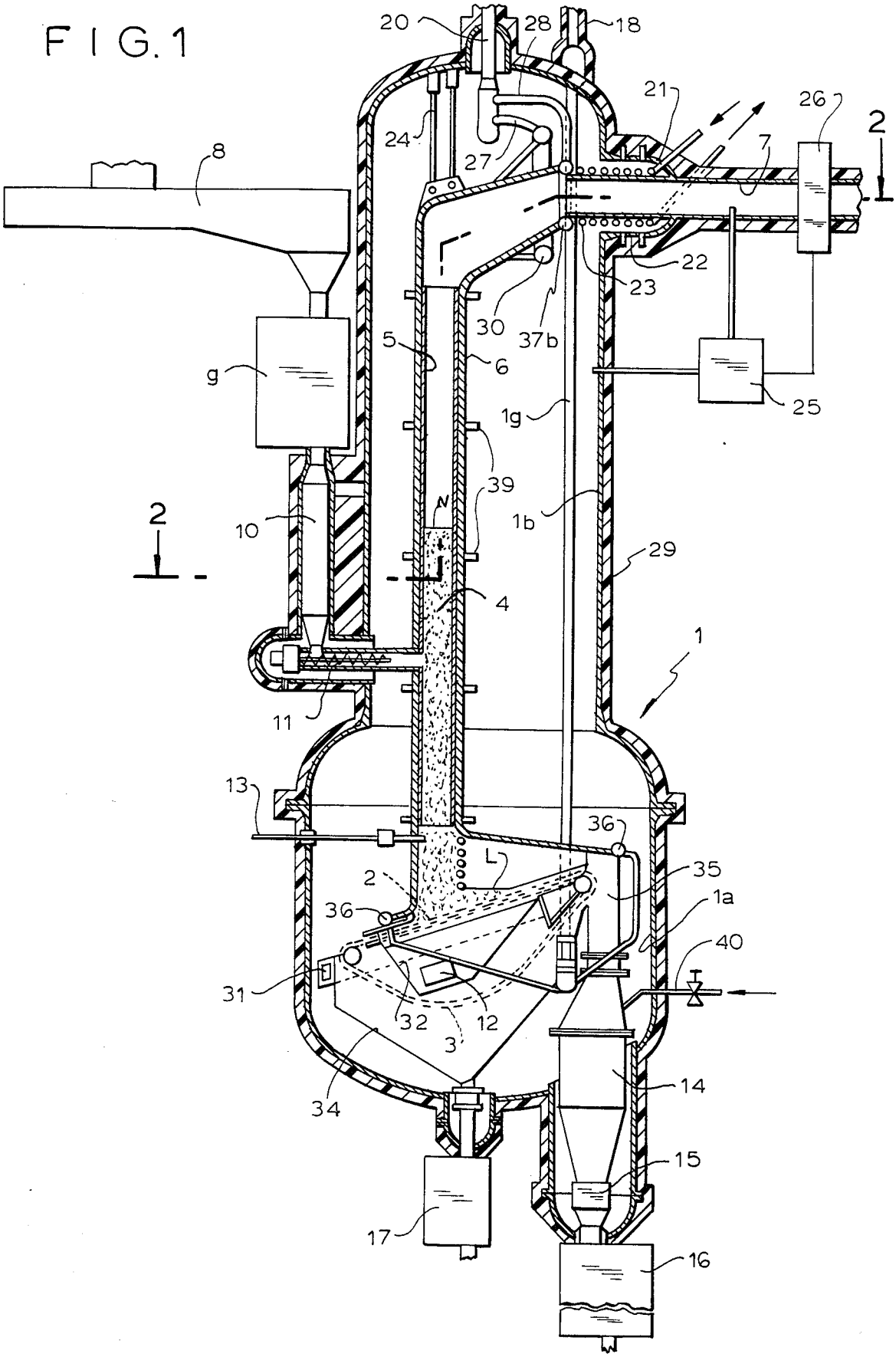
Figure 2:
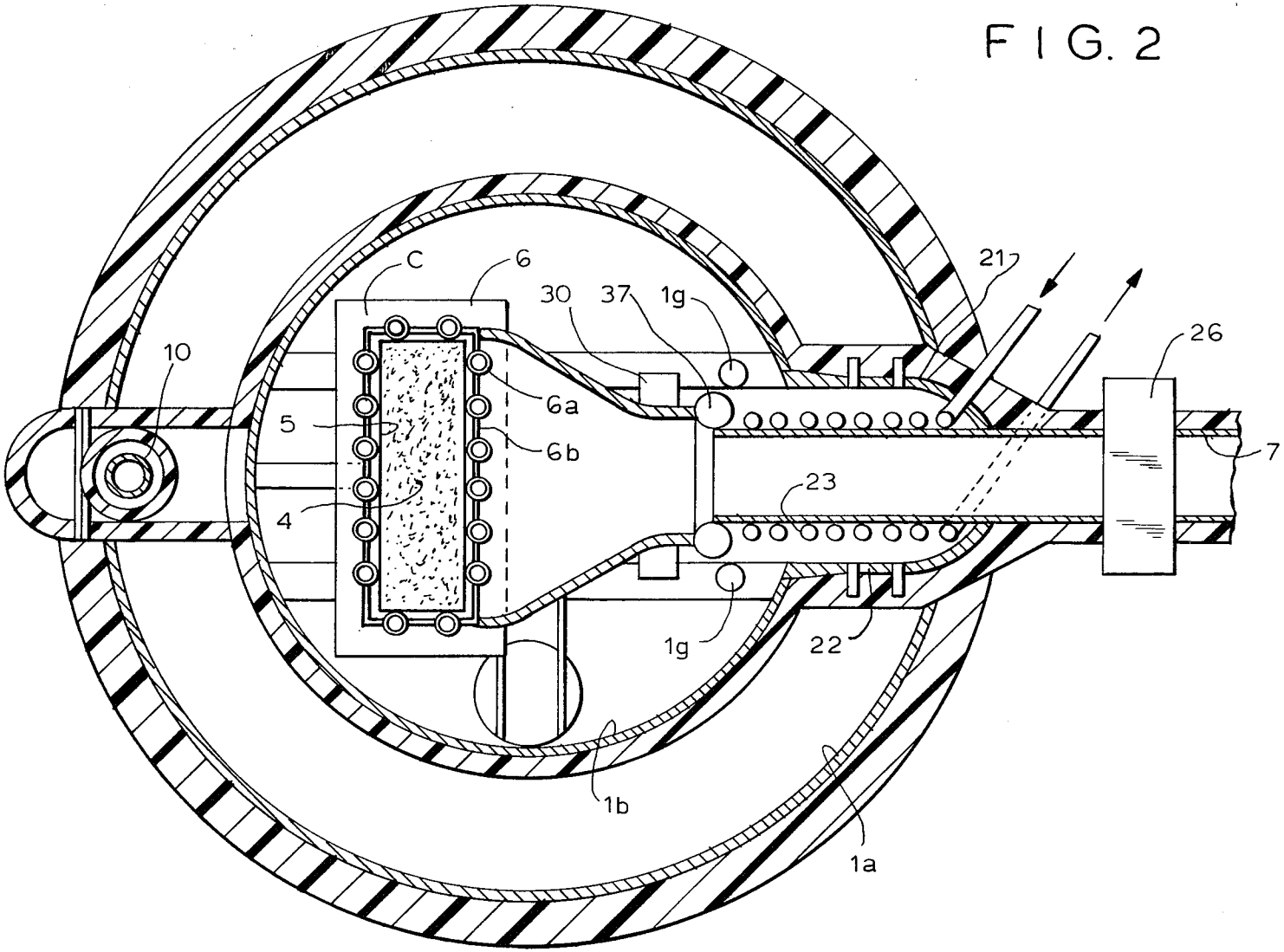
Figure 3:
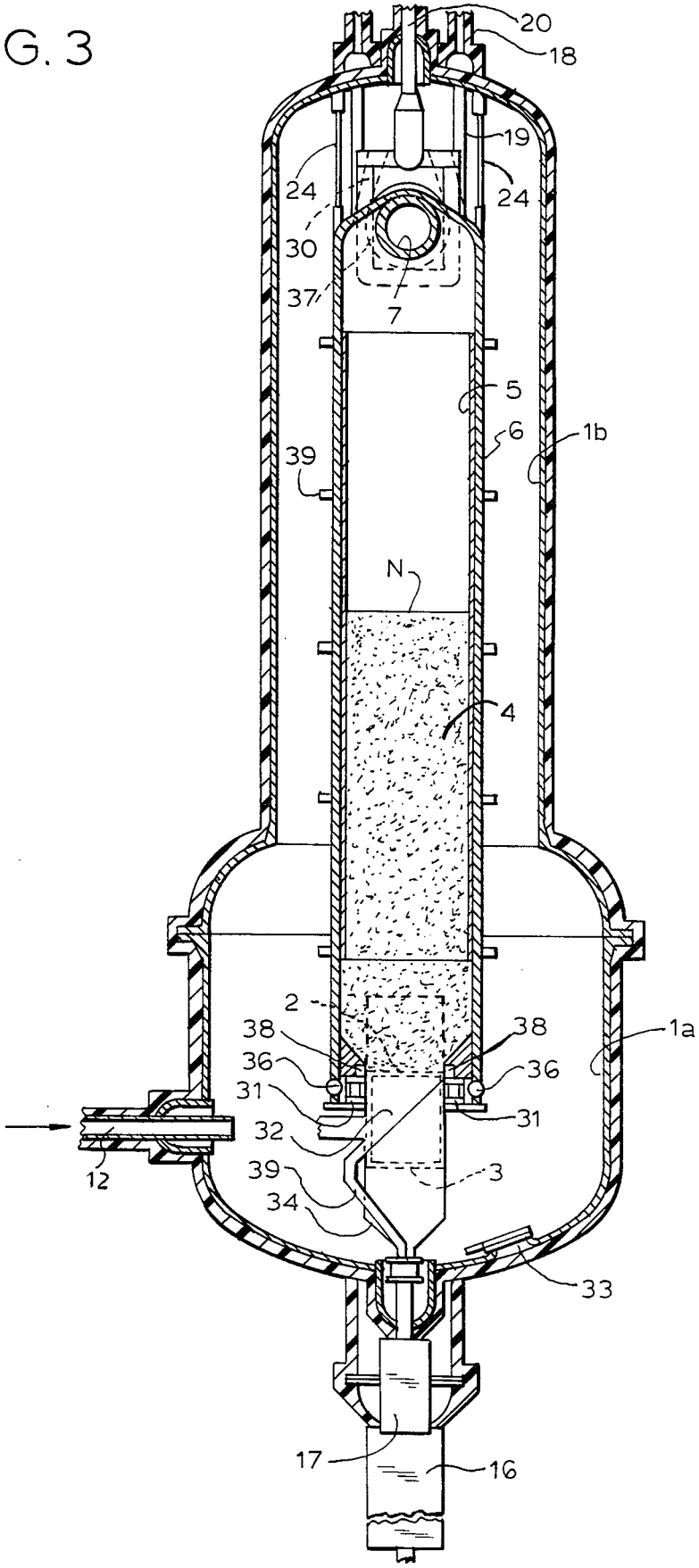

The above and other objects, advantages and features of the present invention will become more apparent from the following detailed description of a now preferred embodiment thereof, taken in conjunction with the generally schematic drawing wherein FIG. 1 is a side elevational view, partly in section, of the coal gasifying apparatus of this invention, FIG. 2 is a transverse section along line A—A of FIG. 1, and FIG. 3 is a view similar to that of FIG. 1 but viewing the apparatus in a direction 90° removed from that of FIG. 1.

Referring now to the drawing, there is shown vessel 1 having walls resisting high pressures of the order of 30 bars (1 millon dynes/sq.cm.) or more and defining an interior. The vessel is generally cylindrical and longitundinally elongated, and it is comprised of two distinct parts, lower vessel part 1*a* having a diameter substantially larger than the diameter of upper vessel part 1*b* which extends upwardly from the lower vessel part and is coaxial therewith. Insulating jacket 29 encases the vessel to prevent heat losses. Covered manhole 33 provides access to the interior of vessel 1.

The interior of the high pressure-resistant vessel contains chamber 4 for gasifying coal forming a fluidized bed on traveling grate 2. The illustrated type of coal gasification device is known by the name of "Ignifluid" and operates with agglomerates of coal ashes. The coal is initially ignited by a suitable starting burner (not shown) and the ignited coal is gasified in the present installation by supplying a blast of water vapor and oxygen to the fluidized bed in the manner described hereinafter. The traveling grate supporting the fluidized bed of coal (agglomerates of ash) is constituted by the upper course of endless grid chain 3 trained over two rollers and inclined upwardly from front to rear in the direction of displacement of the grid chain, thus forming a lower grate portion and an upper grate portion. As shown, traveling grate 2 is positioned in lower vessel part 1*a*.

The traveling grate forms the bottom of gasification chamber 4 which is constituted by the principal chamber of a reactor permitting the establishment of a principal fluidized bed on the lower grate portion and an auxiliary fluidized bed on the upper grate portion, the principal fluidized bed forming the bottom of the gasification chamber. Grate 2 is supported on frame 31 which is suspended in the interior of vessel 1 in a manner to be described hereinafter. The upper course of the traveling grate overlies wind box 32. As shown in FIG. 3, embankments 38 of coal ashes are formed at the sides of the grate on sheet metal parts of frame 31. As shown in FIG. 2, gasification chamber 4 is of rectangular cross section and is defined by walls 6 of vertical boiler tubes 6*a* interconnected by iron plates 6*b* welded to the tubes to form gas-impermeable walls for the gasification chamber. Bracing frames 39 are spaced along the walls to reinforce the structure. The walls are covered by refractory linings 5. The refractory linings extend upwardly to a level above top level N of the fluidized bed contained in chamber 4 (see FIGS. 1 and 3) but do not extend below a level above, and spaced from, traveling grate 2, the lower end of the refractory linings and the traveling grate defining therebetween a zone of agglomeration for the coal ashes supported on the grate. As illustrated, elongated vertical gasification chamber 4 extends from the traveling grate in lower vessel part 1*a* in the interior of the vessel into upper vessel part 1*b*. Outlet pipe or flue 7 is connected to the upper part of gasification chamber 4 and branches off the upper vessel part, the flue constituting means for evacuating a combustible gas product produced in the gasification chamber from the coal. Cooling tubes 23 surround a portion of flue 7 in the interior of vessel 1, as shown in FIG. 1. As shown in FIG. 1, the coil of cooling tubes is connected to an inlet conduit and an outlet conduit, and cooling water is circulated therethrough by a pump (not shown).

Means for delivering coal to the fluidized bed in gasification chamber 4 comprises a generally conventional feeder 8 delivering the coal to lock chamber 9 whence vertical tube 10 feeds the coal to horizontal screw conveyor 11 which passes from the outside of vessel 1 through the wall thereof into the interior where a free end of the screw conveyor is connected to the gasification chamber for discharging the granular coal thereinto. The level of the discharge end of the coal delivering means into gasification chamber 4 is close to the lower end of upper vessel part 1*b* adjacent lower vessel part 1*a* and below level N of the fluidized bed.

The granular coal delivered into the gasification chamber is fluidized by a blast of gas delivered from wind box 32 across traveling grate 2. Means for delivering the blast of gas comprises pipe 12 (see FIG. 3) connected to the vessel wall to deliver the gas at the bottom of lower vessel part 1*a* below the traveling grate. The gas is comprised essentially of a mixture of water vapor and oxygen. The entire interior of vessel 1 surrounding gasification chamber 4 is under the pressure of the gas delivered thereinto through pipe 12, this gas pressure being 30 bars, for example. The upper part of chamber 4 is under a lower pressure because of the pressure loss in the fluidized bed. The water vapor/oxygen gas mixture will gasify the ignited coal and produce a combustible gas product.

A secondary supply of vapor is provided by pipe 13 (see FIG. 1) connected to the lower end of gasification chamber 4 in lower vessel part 1*a* above the traveling grate but substantially below the lower end of refractory linings 5 of gasification chamber 4. This secondary supply of vapor permits the fluidized bed to be cooled above the level of the secondary vapor supply and favors the agglomeration of the ash particles at the bottom of the gasification chamber, which thus constitutes a zone of agglomeration.

Means is also provided for evacuating the agglomerates, for which purpose auxiliary fluidized bed L is established on traveling grate 2 upstream of the principal fluidized bed at the bottom of the gasification chamber. Due to the inclination of the grate, the height of auxiliary fluidized bed L is very small in relation to the height of principal fluidized bed N in gasification chamber 4. The auxiliary fluidized bed is disposed adjacent the principal fluidized bed and in the space between the vessel wall and gasification chamber 4 in lower vessel part 1*a*. Means is provided for maintaining the two fluidized beds in hydrostatic equilibrium, any suitable control being useful for this purpose. The means illustrated herein comprises pressure control 25 capable of comparing the pressures in the upper part of gasification chamber 4 and the space between this chamber and the wall of vessel 1, for which purpose control 25 has input connections to the chamber and the space. This means further comprises valve 26 disposed in flue 7 for the combustible gas product coming from the gasification chamber and responsive to an output signal delivered by control 25, this output control signal being a function of the comparison between the gas pressures in the gasification chamber and the space between the gasification chamber and the vessel wall.

The evacuation of the agglomerates is effected under the same conditions as those described in U.S. Pat. No. 3,982,884, dated Sept. 28, 1976, whose entire disclosure is incorporated herein by way of reference. The upwardly inclined traveling grate causes the agglomerates to be moved from the principal fluidized bed at the bottom of gasification chamber 4 to auxiliary fluidized bed 1 at a somewhat higher level than the principal fluidized bed whence the agglomerates are removed from the free surface of the auxiliary fluidized bed through chute 35.

The means for evacuating the agglomerates comprises container 14 which receives the agglomertaes from the chute and wherein the agglomerates are cooled by water and whence they pass into crusher 15. As shown in FIG. 1, cooling water is supplied through inlet conduit 40 to a bank of atomizing nozzles in container 40 to cool the agglomerates therein by a water spray. The container and crusher are mounted in the interior of vessel 1 at a lower end thereof, and lock chamber 16 outside the vessel is connected to the crusher to receive the discharged agglomerates. Another lock chamber 17 is also mounted outside the vessel at the lower end thereof to receive any coal particles which may have fallen through traveling grate 2 into hopper 34 or wind box 32 for evacuating such cinder particles into lock chamber 17. As shown in FIG. 3, conduit 39 leads from wind box 32 to lock chamber 17 to deliver cinders from the wind box thereinto.

The boiler formed by the tubes 6*a* of walls 6 will now be described, together with its function.

Two water inlets 18 coming from water reservoirs (not shown) of the boiler are connected to the upper end of vessel 1. These water inlets are preferably equipped with thermal insulating jackets. A respective vertical pipe 19 is attached to each water inlet and forms an extension thereof in the interior of vessel 1 to deliver the water into the tubes of boiler wall 6 at a lower part thereof. Pipe 20 mounted in the top of vessel 1 receives an emulsion of water and water vapor formed in the boiler tubes 6*b* as the water rises in the tubes, the upper end of the tubes being connected to pipe 20 by branch pipings 27 and 28 to remove the water/water vapor emulsion from the boiler tubes. This emulsion is collected in annular collector tubes 30 and 37 connected to the boiler tubes and pipings 27 and 28 connect the collector tubes to discharge pipe 20. A fraction of the water fed to the boiler tubes may be utilized to feed cooling tube coil 23 for cooling flue 7 which removes the combustible gas product from the gasification chamber. For this purpose, a portion of outlet pipe 7 positioned in the interior of the vessel is housed in bulging wall portion 21 wherein cooling tube 23 is lodged. Expansion bellows 22 attaching bulging wall portion 21 to the wall of vessel 1 compensates for displacements of outlet pipe 7.

Four mains 36, one for each wall 6, are connected to water feed pipes 19, as shown in FIG. 1, which support at their lower ends frame 31 of traveling grate 2. Furthermore, rods 24 affixed to the top of vessel 1 support tubular walls 6 disposed in the longitudinal extension of grate 2 and these walls also support the frame of the grate at their lower ends.

The above-described boiler assures a portion or a totality of the production of the vapor injected into vessel 1 by pipe 12 and of the vapor injected by pipe 13 into chamber 4. If only a portion of the required vapor is produced by the boiler, the rest is furnished buy a suitable recovery boiler of any known structure, which is positioned downstream of the gas outlet.

While the invention has been described in connection with a specific, now preferred embodiment, it will be obvious to those skilled in the art that many modifications may be introduced therein without departing from the spirit and scope of this invention, as defined in the appended claims. More particularly, any one of the described structures may be replaced by structures operating in an equivalent manner.

What is claimed is:

1. An installation for gasifying coal in a fluidized bed under high pressure, which comprises (a) a vessel having walls resistant to the high pressure and defining an interior, (b) a reactor disposed in the interior and having a principal walled chamber constituting a gasification chamber having a bottom and permitting the establishment of a principal fluidized bed of substantial depth and an auxiliary fluidized bed of a smaller depth, (c) an inclined traveling grate, the grate having (1) a lower grate portion supporting the principal fluidized bed and forming the bottom of the gasification chamber, and (2) an upper grate portion supporting the auxiliary bed situated in a space between the vessel walls and the gasification chamber, and (d) means for maintaining the principal and auxiliary fluidized beds in hydrostatic equilibrium.

2. The installation of claim 1, further comprising means connected to the vessel for feeding the coal and for delivering a blast of gas to the gasification chamber, and for removing agglomerates and combustible gas products therefrom.

3. The installation of claim 2, wherein the means for delivering a blast of gas comprises a pipe for introducing a mixture of water vapor and oxygen.

4. The installation of claim 2, wherein the means for feeding coal comprises a feeder delivering the coal, a lock chamber receiving the coal delivered by the feeder, the feeder and the lock chamber being disposed outside the vessel, and a conduit and a screw conveyor disposed inside the vessel, the conduit delivering the coal from the lock chamber to the screw conveyor and the screw conveyor being connected to the gasification chamber.

5. The installation of claim 2, wherein the means for removing combustible gas products from the gasification chamber comprises a flue connected to an upper part of the vessel and leading to an upper part of the gasification chamber for receiving the combustible gas products therefrom, and means for cooling the flue.

6. The installation of claim 2, wherein the means for removing agglomerates comprises a container receiving the agglomerates from the grate and including water cooling means for cooling the agglomerates, a crusher connected to the container and receiving the cooled agglomerates therefrom, the container and the crusher being disposed in the interior of the vessel, an outlet lock chamber disposed outside the vessel, and a conduit passing through the vessel walls connecting the crusher to the outlet lock chamber.

7. An installation for gasifying coal in a fluidized bed under high pressure, which comprises (a) a vessel having walls resistant to the high pressure and defining an interior, (b) a reactor disposed in the interior and having a principal walled chamber constituting a gasification chamber having a bottom and permitting the establishment of a principal fluidized bed of substantial depth and an auxiliary fluidized bed of a smaller depth, (c) an inclined traveling grate, the grate having (1) a lower grate portion supporting the principal fluidized bed and forming the bottom of the gasification chamber, and (2) an upper grate portion supporting the auxiliary bed situated in a space between the vessel walls and the gasification chamber, (d) means for maintaining the principal and auxiliary fluidized beds in hydrostatic equilibrium, (e) means connected to the vessel for feeding the coal and for delivering a blast of gas to the gasification chamber, and for removing agglomerates and combustible gas products therefrom, the means for delivering a blast of gas comprising a pipe for introducing a mixture of water vapor and oxygen, and (f) a secondary supply of water vapor connected to a lower end of the gasification chamber.

8. An installation for gasifying coal in a fluidized bed under high pressure, which comprises (a) a vessel having walls resistant to the high pressure and defining an interior, (b) a reactor disposed in the interior and having a principal walled chamber constituting a gasification chamber having a bottom and permitting the establishment of a principal fluidized bed of substantial depth and an auxiliary fluidized bed of a smaller depth, (1) the gasification chamber being defined by walls formed by vertical boiler tubes, a zone of agglomeration for coal ashes resulting from the gasification of the coal being formed immediately above the grate, and further comprising refractory linings covering the walls of the gasification chamber, except in said zone, (c) an inclined traveling grate, the grate having (1) a lower grate portion supporting the principal fluidized bed and forming the bottom of thegasification chamber, and (2) an upper grate portion supporting the auxiliary bed situated in a space between the vessel walls and the gasification chamber, and (d) means for maintaining the principal and auxiliary fluidized beds in hydrostatic equilibrium.

9. An installation for gasifying coal in a fluidized bed under high pressure, which comprises (a) a vessel having walls resistant to the high pressure and defining an interior, (b) a reactor disposed in the interior and having a principal walled chamber constituting a gasification chamber having a bottom and permitting the establishment of a principal fluidized bed of substantial depth and an auxiliary fluidized bed of a smaller depth, (c) an inclined traveling grate, the grate having (1) a lower grate portion supporting the principal fluidized bed and forming the bottom of the gasification chamber, and (2) an upper grate portion supporting the auxiliary bed situated in a space between the vessel walls and the gasification chamber, and (d) means for maintaining the principal and auxiliary fluidized beds in hydrostatic equilibrium, comprising a pressure control capable of comparing the pressures in an uppr part of the gasification chamber and the space between the vessel walls and the gasification chamber, the pressure control generating a control signal which is a function of the comparison between said pressures, and a valve disposed in a flue for removing combustible gas products from the gasification chamber and responsive to said control signal.

10. The installation of claim 8, further comprising means connected to the vessel for feeding water to the boiler tubes and for removing a water-vapor emulsion produced in the tubes therefrom.

11. The installation of claim 8, further comprising means for delivering a blast of a gas mixture of water vapor and oxygen to the gasification chamber, means for delivering a secondary supply of water vapor to a lower end of the gasification chamber, and means for feeding water vapor from the boiler tubes to said means for providing at least a portion of the water vapor in the gas mixture and the secondary supply.

12. The installation of claim 8, further comprising pipes for feeding water to the vertical boiler tubes and rods suspending the vertical tubes of the gasification walls on the walls of the vessel, the traveling grate being supported on the water feeding pipes and the vertical boiler tubes.

13. The installation of claim 3, wherein the pipe is so connected to the vessel that the interior of the vessel surrounding the gasification chamber is under the pressure of the gas delivered thereinto through the pipe.

14. The installation of claim 7, wherein the pipe is so connected to the vessel that the interior of the vessel surrounding the gasification chamber is under the pressure of the gas delivered thereinto through the pipe.

* * * * *